US006119969A

United States Patent [19]

Racine

[11] Patent Number: 6,119,969

[45] Date of Patent: Sep. 19, 2000

[54] MILL TRUNNION SEAL SPACER IN COAL-BURNING UTILITY ELECTRICAL POWER GENERATION PLANT

[75] Inventor: David G. Racine, Ishpeming, Mich.

[73] Assignee: Wisconsin Electric Power Company (WEPCO), Milwaukee, Wis.

[21] Appl. No.: 09/315,915

[22] Filed: May 20, 1999

[51] Int. Cl.[7] ..... B02C 17/18

[52] U.S. Cl. ..... 241/101.2; 241/179; 241/299; 277/903

[58] Field of Search ..... 277/903, 500; 241/179, 101.2, 299; 110/222, 106

[56] References Cited

U.S. PATENT DOCUMENTS

| | | | |
|---|---|---|---|
| 2,063,368 | 12/1936 | De La Roza | 277/903 |
| 4,966,471 | 10/1990 | Trozzi | 277/903 |
| 5,000,462 | 3/1991 | Trozzi | 241/179 |

*Primary Examiner*—Mark Rosenbaum
*Attorney, Agent, or Firm*—Andrus, Sceales, Starke & Sawall, LLP

[57] ABSTRACT

A coal-burning utility electrical power generation plant includes a mill provided by a rotary drum for pulverizing coal. The drum is rotational about an axis and has mill heads at distally opposite axial ends thereof. Each mill head has a cylindrical mill head extension extending axially, and a stationary cylindrical seal ring concentric with the mill head extension and defining an annular gap therebetween. A pair of axially spaced annular seals are provided between the mill head extension and the seal ring, and seal the annular gap therebetween to prevent leakage of coal dust through the annular gap. A spacer is provided between the seals and maintains the seals in axially spaced relation and prevents rolling movement of the seals into the annular interfaces between the spacer and the mill head extension and between the spacer and the seal ring as the mill head extension rotates relative to the seal ring, to prevent coal dust bypass, and leakage to atmosphere.

10 Claims, 13 Drawing Sheets

MILL TRUNNION SEAL SPACER IN COAL-BURNING UTILITY ELECTRICAL POWER GENERATION PLANT

BACKGROUND AND SUMMARY

The invention relates to coal-burning utility electrical power generation plants, and more particularly to a mill head trunnion seal spacer.

In a coal-burning utility electrical power generation plant, a ball tube mill is provided for pulverizing the coal. The mill includes a drum rotational about an axis and having mill heads at distally opposite axial ends thereof The mill heads have mill head extensions extending axially. Stationary cylindrical seal rings and seal sleeves are concentric with the mill head extensions and define an air gap therebetween. The rings have air fittings for introducing air to the mill head to create a pressure differential at the area of the seal, to prevent coal dust from entering such area. Each axial end mill head has a seal cage with a pair of spaced annular seals between the respective mill head extension and ring, and sealing the annular gap therebetween to prevent leakage of coal dust through such annular gap. A spacer is provided between the seals to maintain the seals in axially spaced relation.

In the prior art, problems have been experienced with leakage of coal dust past the seals. In accordance with the present invention, it is believed that such leakage is due to rolling movement of the seals within the seal cage, permitting bypass of coal dust. The rolling movement of the annular seals is transverse to the direction of rotation of the mill head and parallel to the axis of such rotation. In accordance with this belief and recognition, the present invention addresses the coal dust leakage problem by modifying the spacer to prevent the noted rolling or other creeping of the seals between the spacer and the mill head extension and between the spacer and the ring. The spacer of the present invention has been found particularly effective, and has substantially reduced the noted coal dust leakage problem, including over longer life spans than in the prior art.

DETAILED DESCRIPTION

Figure 1:
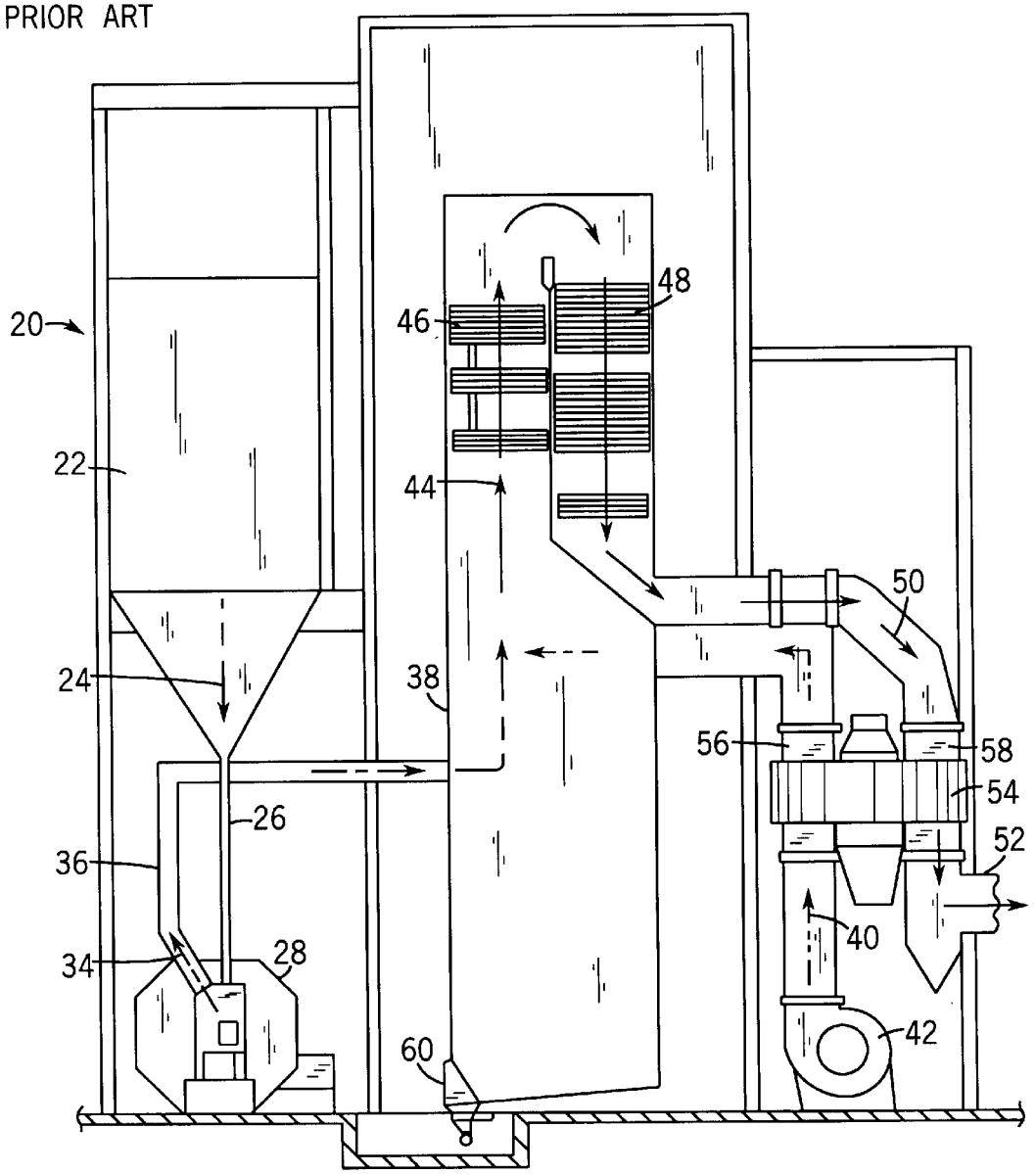
FIG. 1 PRIOR ART
FIG. 1 is a schematic illustration of a portion of a coal-burning utility electrical power generation plant.

FIG. 1 shows a portion of a coal-burning utility electrical power generation plant 20. Coal is loaded into hopper 22 and gravity fed as shown at arrow 24 to inlet duct 26 of ball tube mill 28. The mill includes a rotary drum 30, FIG. 2, with a charge or plurality of balls 32, FIG. 4, therein which pulverize the coal as the drum rotates. The pulverized coal dust is discharged as shown at arrow 34, FIG. 1, to outlet duct 36 for introduction to the burner of boiler 38. Incoming combustion air is supplied as shown at arrow 40 from fan 42. The heat of combustion of the air and coal dust is supplied as shown at arrow 44 through a plurality of heat exchangers 46, 48, to generate steam to in turn drive electrical power generating turbines, as is standard. After giving up heat for the noted steam generation, exhaust including fly ash flows as shown at arrow 50 to exhaust outlet 52. An air preheater duct 54 is connected between combustion air inlet duct 56 and exhaust outlet duct 58 for transferring heat from the exhaust flow at 50 to the incoming combustion air flow at 40 to pre-heat the latter. The spent coat dust, after ignition and burning, fuses as hardened chunks, called bottom ash clinkers, and are collected and ground at lower clinker grinder 60, for discharge and disposal.

Figure 2:
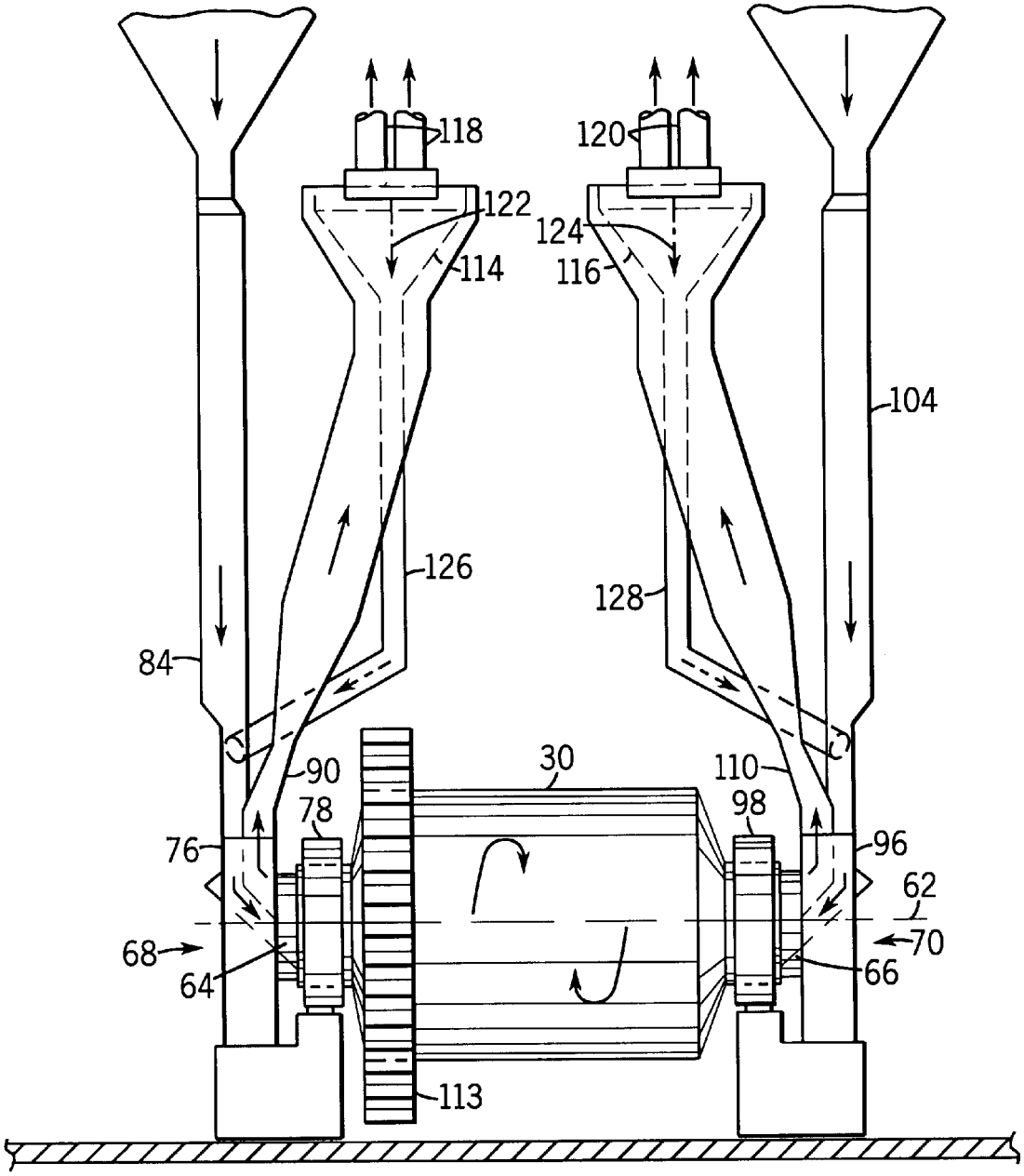
FIG. 2 PRIOR ART
FIG. 2 is a schematic side view of the mill of FIG. 1.
Figure 3:
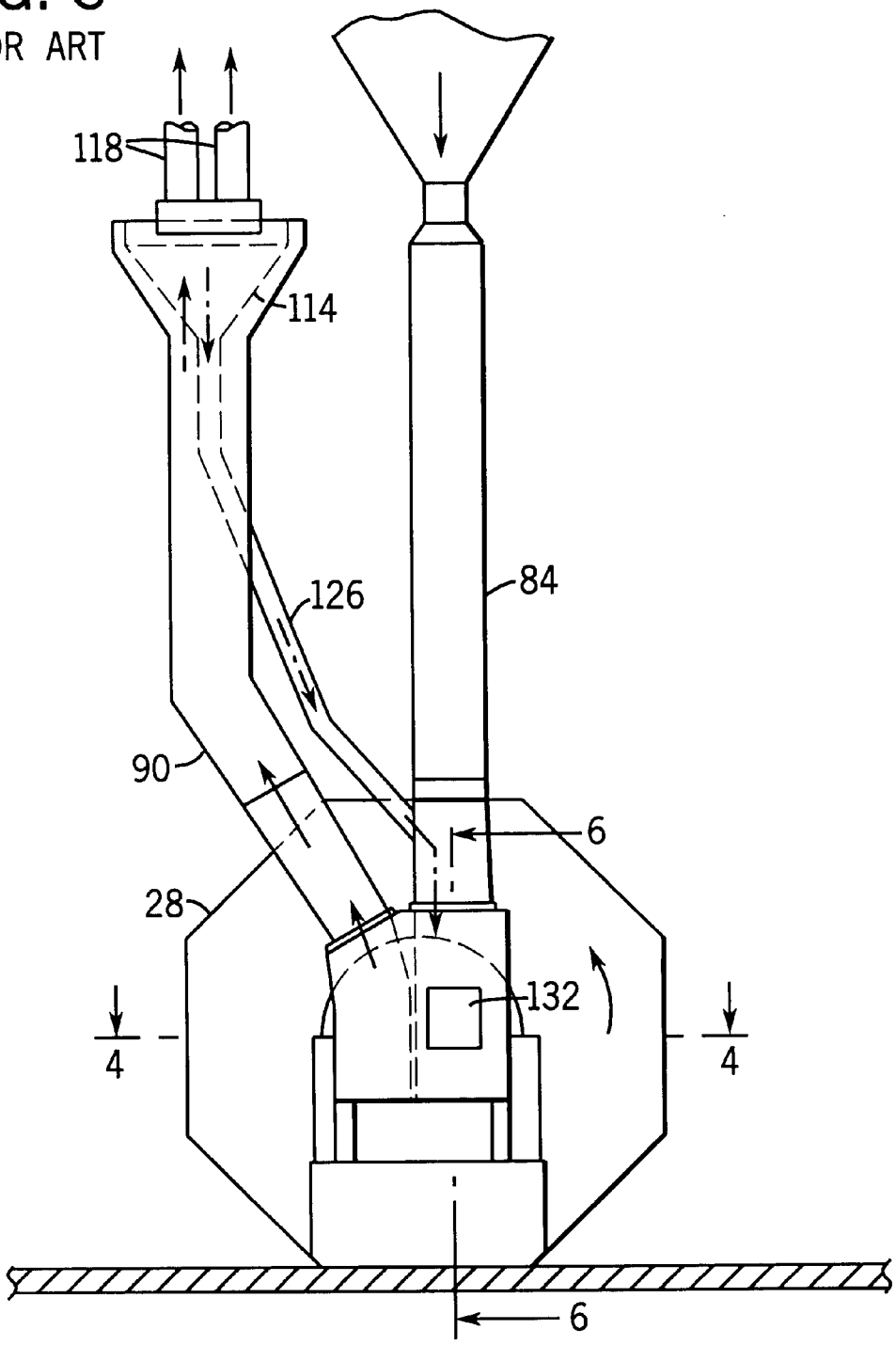
FIG. 3 PRIOR ART
FIG. 3 is an enlarged schematic view of a portion of FIG. 1.

Drum 30, FIG. 2, rotates about an axis 62 and has a pair of mill heads 64 and 66 at the respective axial ends 68 and 70 thereof. Each mill head has a respective stationary divider plate 72 and 74, FIG. 4, dividing its respective mill head into an entrance or inlet side receiving coal, and an exit or outlet side discharging pulverized coal dust. Stationary divider plate 72 is rigidly mounted, for example, by welding, to stationary framework 76 which supports mill head 64 at trunnion bearing 78 for rotation of drum 30. Divider plate 72 divides mill head 64 into an entrance 80 receiving coal as shown at arrow 82 from inlet duct 84, and an exit 86 discharging pulverized coal dust as shown at arrow 88 to outlet duct 90. Mill head 64 includes spiral wound rifling 92 along its inner perimeter to channel coal from entrance 80 into central crushing pulverizing zone 94 as the drum rotates, such that the coal is pulverized by balls 32. Stationary divider plate 74 is rigidly fixed, typically by welding, to framework 96 which supports mill head 66 at bearing 98 for rotation of the drum. Stationary divider plate 74 divides mill head 66 into an entrance 100 receiving coal as shown at arrow 102 from inlet duct 104, and an exit 106 discharging coal dust as shown at arrow 108 to outlet duct 110. Mill head 66 has internal rifling 112 to channel the coal into pulverizing zone 94 during rotation of the drum. Drum 30 has an outer ring gear 113 driven by helical gearing (not shown), to rotate the drum.

As shown in FIG. 2, the exiting coal dust from each axial end mill head is supplied through respective outlet ducts 90 and 110, and swirls around respective frusto-conical collectors 114 and 116, such that the lighter dust particles continue through conduits 118 and 120 to burner 38, FIG. 1, and the heavier particles are collected in such frusto-conical collectors 114 and 116 and are recycled as shown as respective arrows 122 and 124 and return ducts 126 and 128 back to respective inlet ducts 84 and 104. Drum 30 is typically lightly pressurized with a slightly higher internal pressure than atmospheric, to facilitate discharge of coal dust through exits 86 and 100 to respective outlet ducts 90 and 104.

Figure 4:
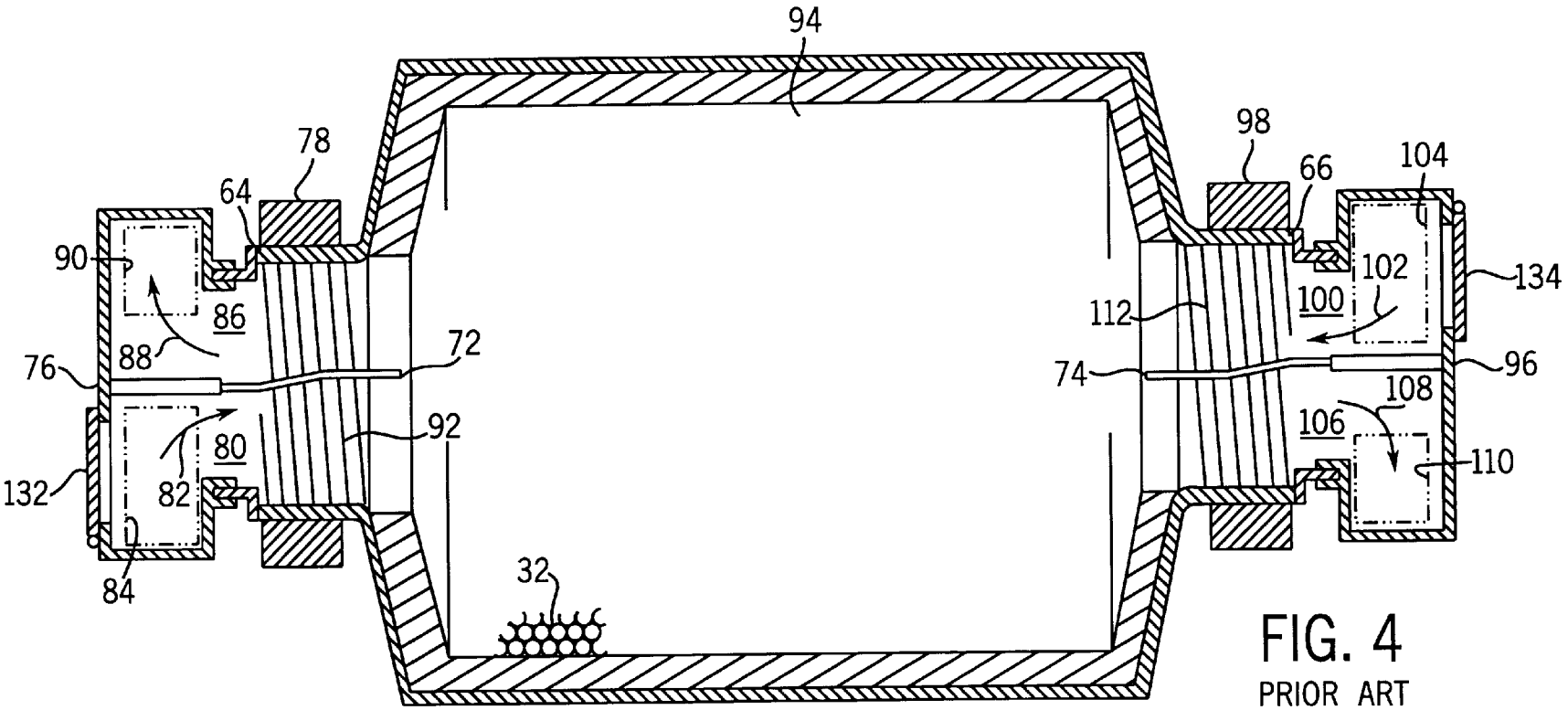
FIG. 4 PRIOR ART
FIG. 4 is a sectional view taken along line 4—4 of FIG. 3.
Figure 6:
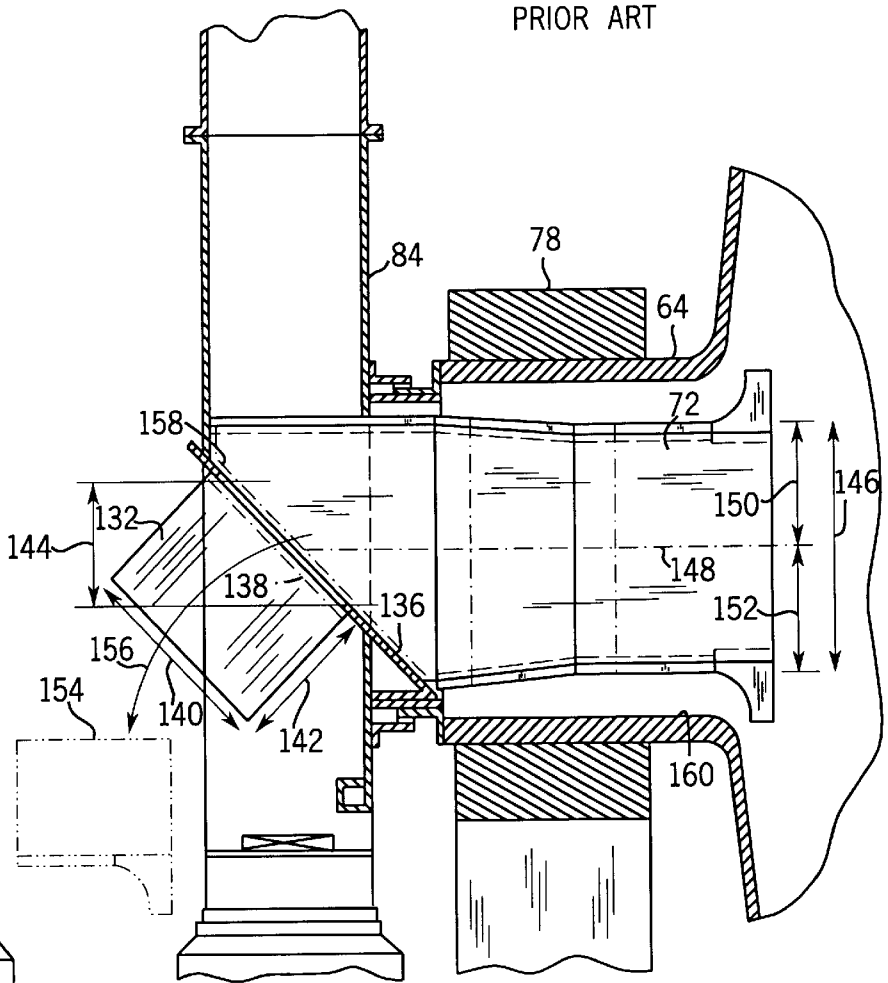
FIG. 6 PRIOR ART
FIG. 6 is a sectional view taken along line 6—6 of FIG. 3.
Figure 5:
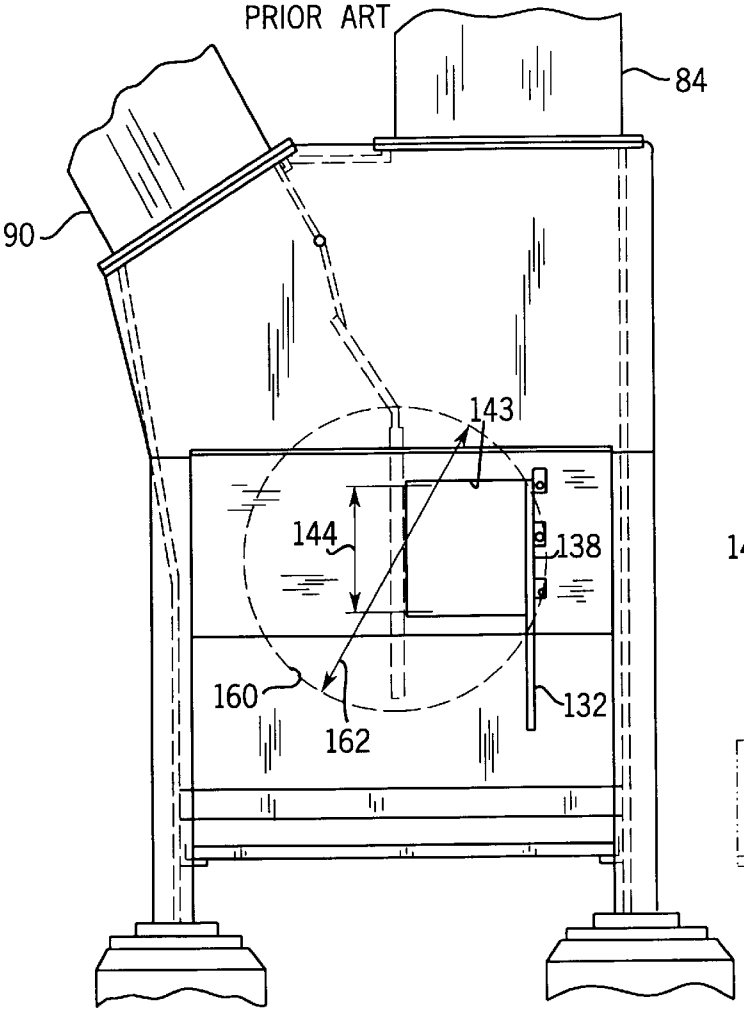
FIG. 5 PRIOR ART
FIG. 5 is an end view of the mill head of FIG. 4.
Figure 8:
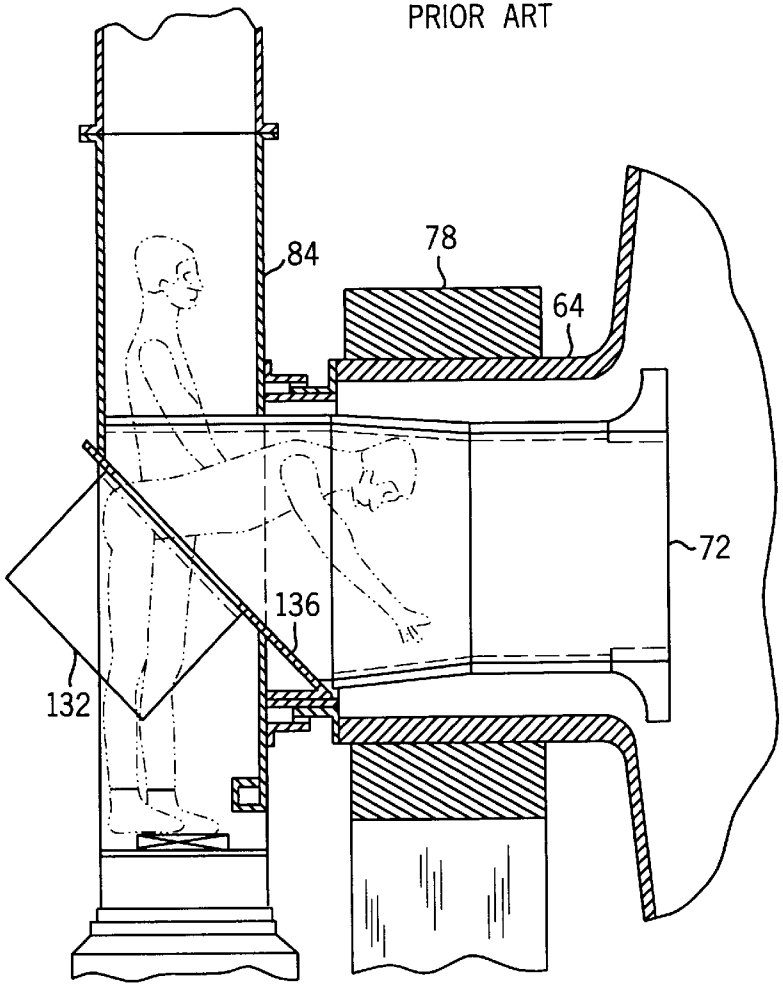
FIG. 8 PRIOR ART
FIG. 8 is a view like FIG. 6, and schematically illustrates servicing by maintenance personnel.
Figure 7:
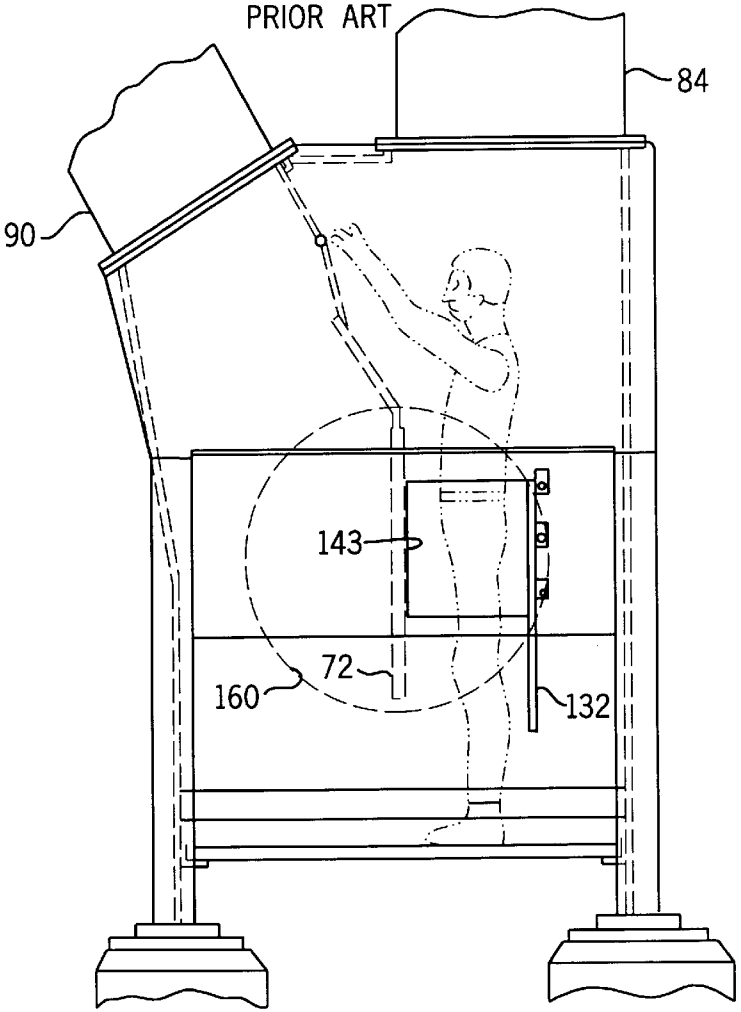
FIG. 7 PRIOR ART
FIG. 7 is a view like FIG. 5, and schematically illustrates servicing by maintenance personnel.

Openable doors 132 and 134, FIG. 4, are provided on the opposite axial end mill heads and are moveable between a closed position, FIG. 4, and an open position, FIGS. 5–8. The door is hinged to the axial end of the mill head along a downwardly and axially sloped diagonal stationary wall 136, FIG. 6, along a hinge line 138. The door is typically about 21 inches high as shown at dimension 140, and 16 inches wide, as shown at dimension 142, which are approximately the same dimensions as the door opening 143 in diagonal wall 136. When the door is swung open along diagonal hinge line 138, the vertical projection of the door opening is shown at dimension 144. The vertical height 146 of divider plate 72 is greater than dimension 144, and hence divider plate 72 must be cut into smaller pieces to enable removal thereof through the door opening. Divider plate 72 is typically cut along axial line 148 into halves, each having a respective vertical dimension 150,152 no greater than dimension 144. Each of these halves is then typically cut along one or more vertical lines into further sub-pieces, one of which is shown in FIG. 6 at 154 removed through door opening 143 as shown at arrow 156. Divider plate 72 has a left diagonal end 158 welded to diagonal wall 136 to stationarily mount divider plate 72 in mill head 64 to divide the latter into the noted entrance 80 and exit 86. The mill head has an inner perimeter as shown at 160, FIG. 5, having an inner diameter 162 of about four feet. FIGS. 7 and 8 schematically illustrate the cramped conditions within which maintenance personnel have to work to service the ductwork, for example in FIG. 7, and the mill head, FIG. 8, including cutting and removing of divider plate 72.

Figure 9:
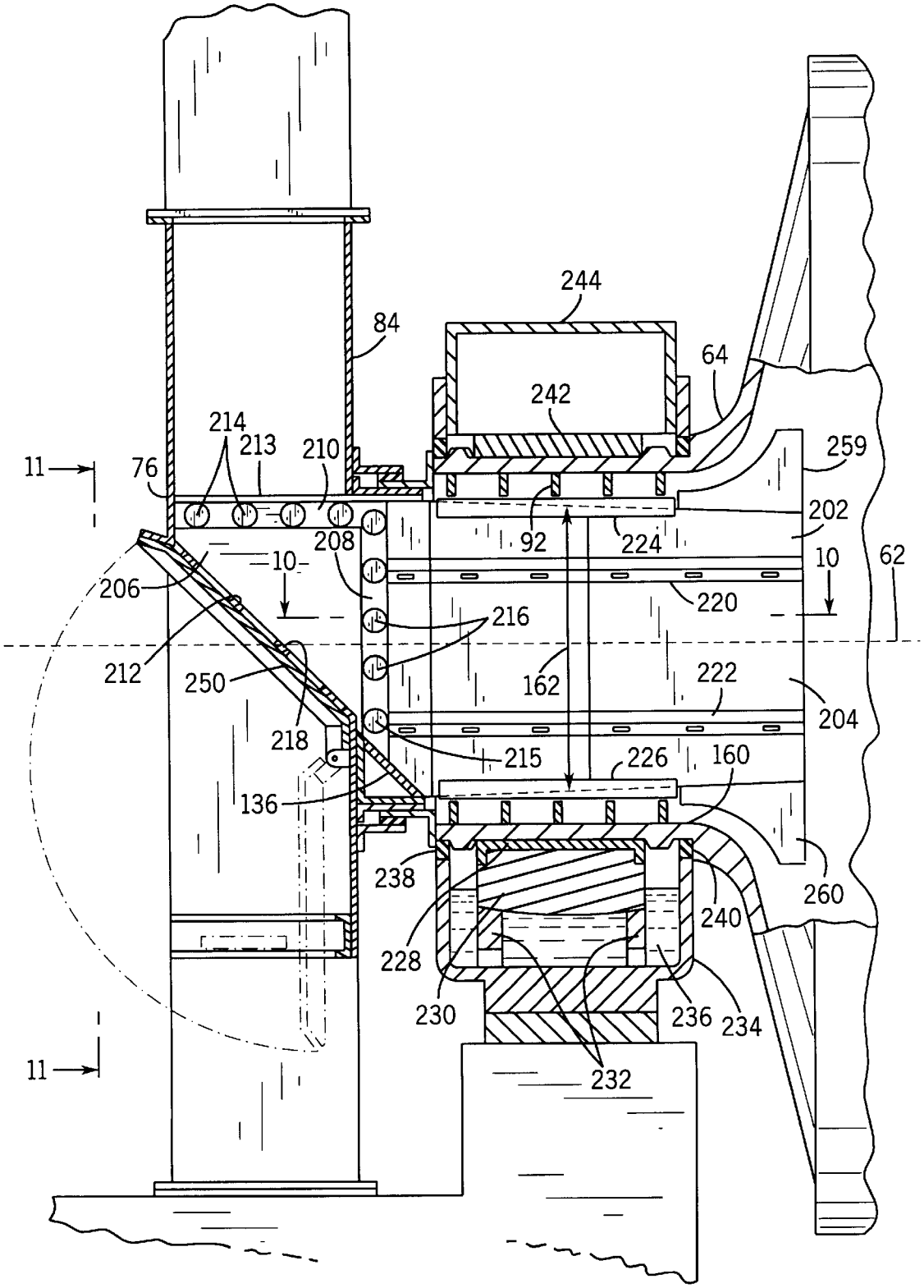
FIG. 9 is a side sectional view of a mill head modified design in accordance with commonly owned copending U.S. application Ser. No. Attorney Docket 2009-00013, filed on even date herewith.
Figure 10:
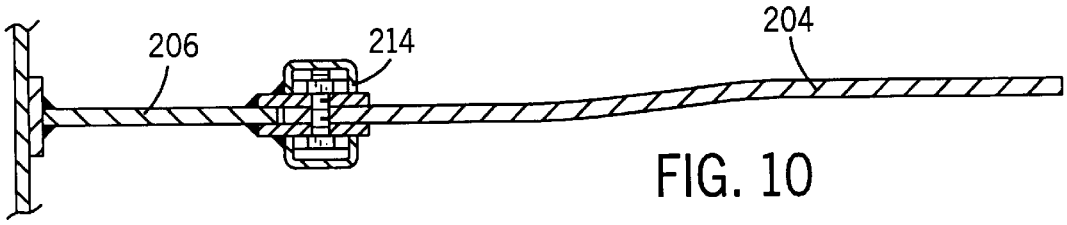
FIG. 10 is a sectional view taken along line 10—10 of FIG. 9.

FIGS. 9–14 show a mill modified in accordance with commonly owned copending U.S. application Ser. No. attorney docket 2009-00013, filed on even date herewith, and use like reference numerals from above where appropriate to facilitate understanding. Divider plate 72 of FIGS. 1–8 is replaced with a divider plate 202, FIG. 9, having a first portion 204 within inner perimeter 160 at rifling 92, and an axial end portion 206 which is triangular, including a substantially vertical leg 208 extending along inner diameter 162, a substantially horizontal leg 210 extending axially outwardly from vertical leg 208, and a diagonal leg 212 joining the vertical and horizontal legs. Axial end triangular portion 206 is bolted to the stationary framework 76. An upper horizontal support rail 213 is welded to stationary framework 76, and end portion 206 is bolted to rail 213 at a plurality of bolts 214. The lower end of portion 206 is bolted to end wall 136 at bolt 215. Inner divider plate 204 is bolted to portion 206 by a plurality of bolts 216. Diagonal leg 212 of end portion 206 is bolted to door 250 by a plurality of bolts 218. Divider plate portion 204 further preferably has one or more angle iron guides 220,222 welded thereto and providing additional support against bending. Also added to the plate are upper and lower dimensional tolerance strips 224,226 which are welded or otherwise attached to the upper and lower edges of the divider plate to provide a very small tolerance gap, preferably about ¼ inch, to the rifling at 92, to prevent bypass of larger chunks of coal from entrance 80 to exit 86. FIG. 9 also shows further details of the trunnion bearing supporting rotation of the drum at mill head 64, including a semi-circular half moon bearing 228 on backing 230 on support blocks 232 in oil reservoir 234 filled with oil 236 and having annular cross-sectionally-square packing seals 238, 240, an upper race 242, and an upper cap 244.

Figure 11:
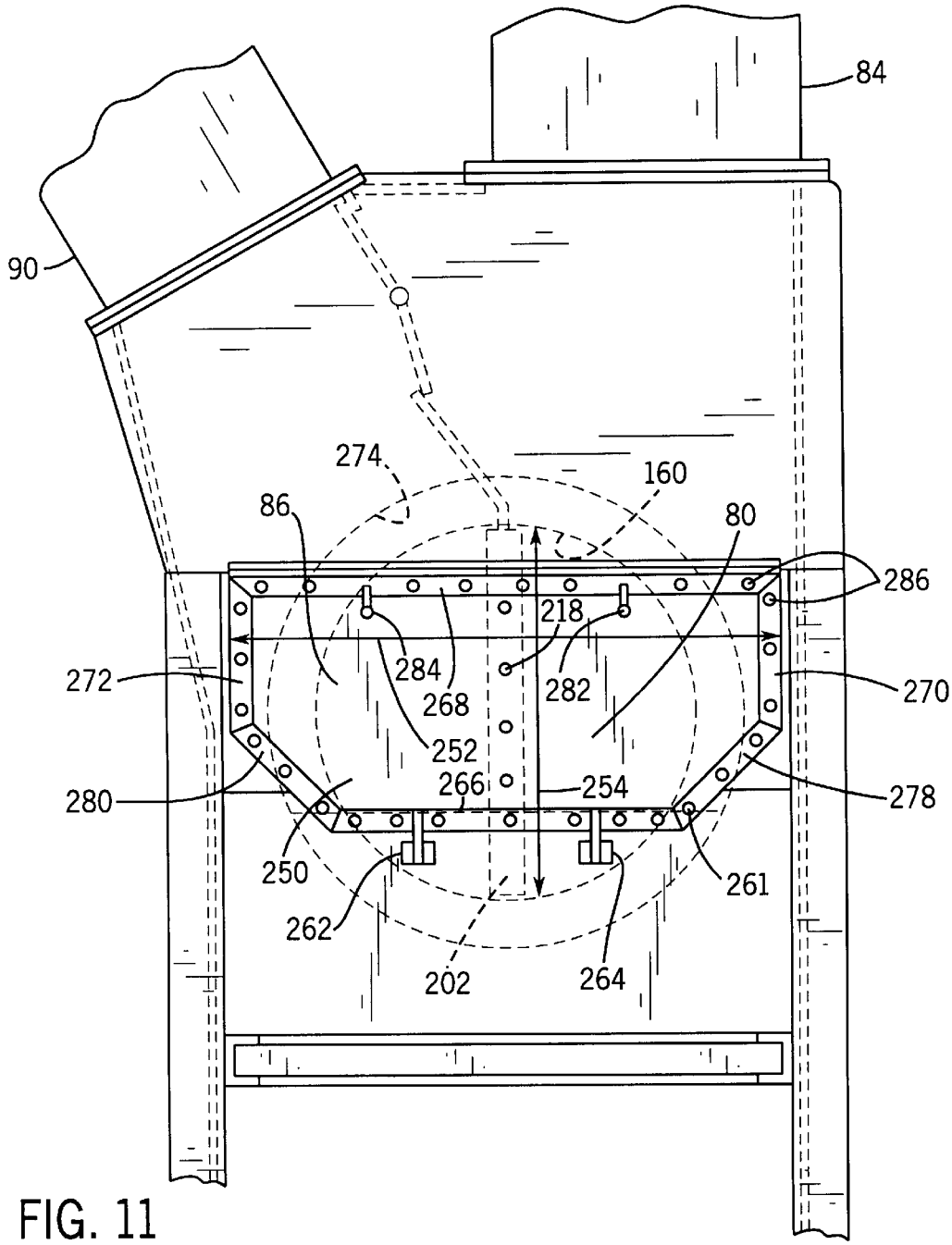
FIG. 11 is an end view taken along line 11—11 of FIG. 9.
Figure 12:
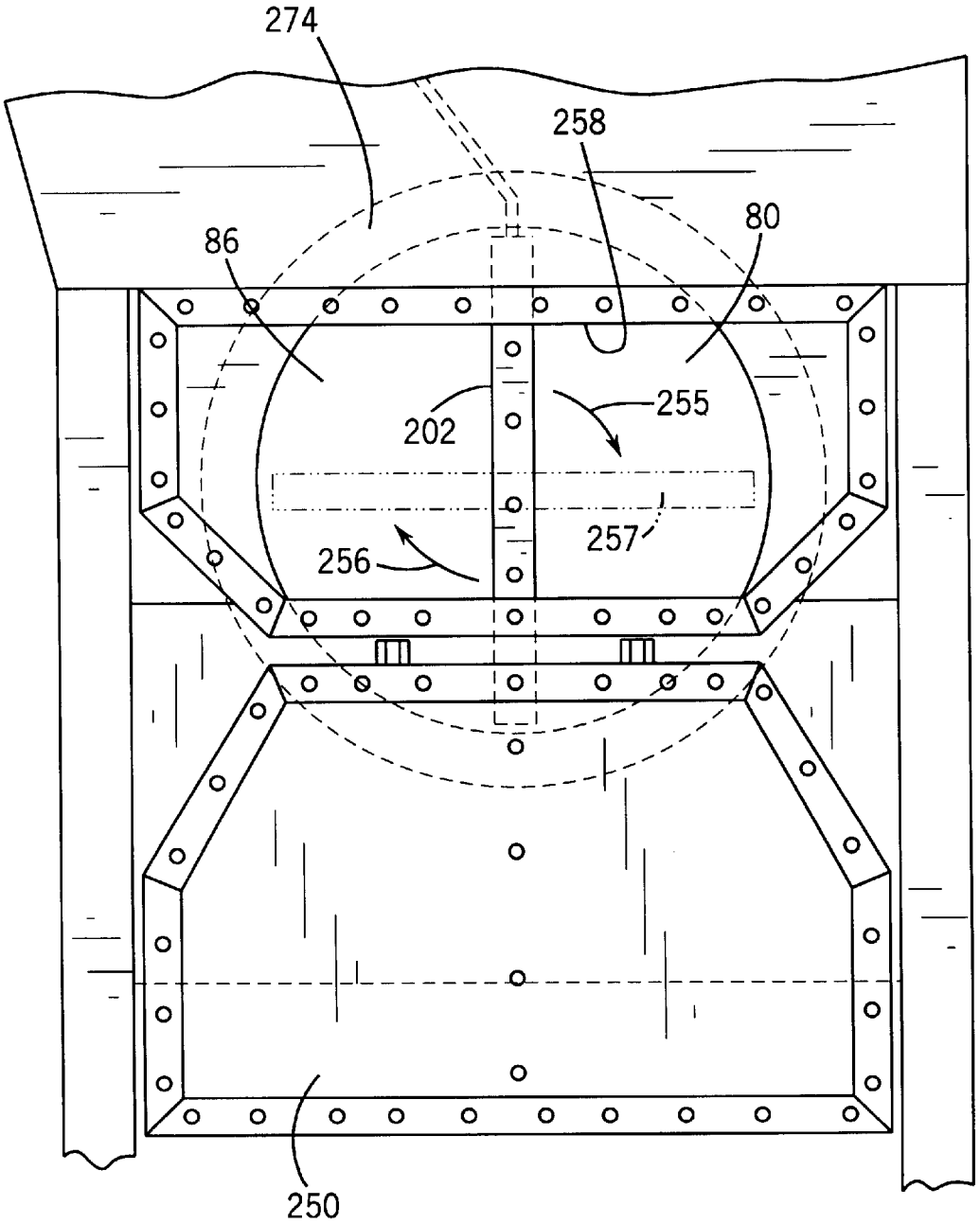
FIG. 12 is like FIG. 11 and shows the door in an open position.
Figure 13:
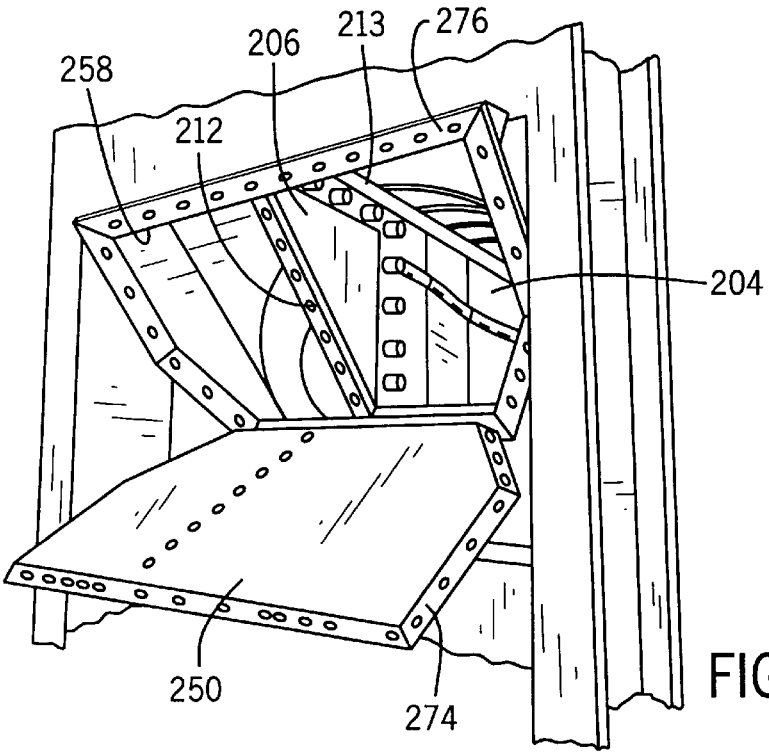
FIG. 13 is a perspective view of the mill head with the door in the open position.
Figure 14:
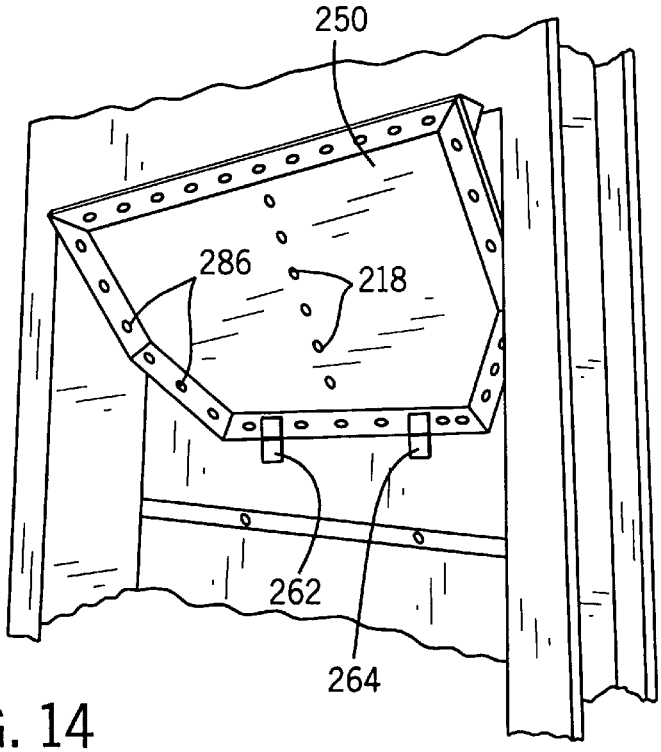
FIG. 14 is a perspective view of the mill head with the door in the closed position.

Openable door 250 on the mill head is moveable between a closed position, FIGS. 9,11 and 14, and an open position, FIGS. 12 and 13. In the closed position, door 250 is intersected by axis 62, which is the rotational axis of drum 30. Mill head inner diameter 162 is bisected by axis 62. Door 250 has a lateral dimension 252, FIG. 11, transverse to axis 62 and greater than inner diameter 162. Divider plate 202 extends along a lateral dimension 254, FIG. 11, transverse to axis 62 and also transverse to lateral dimension 252 of door 250. Lateral dimension 252 of door 250 extends horizontally, and lateral dimension 254 of divider plate 202 extends vertically. Divider plate 202 extends generally vertically in the mill head and has a height in the mill head substantially equal to inner diameter 162. Removal of divider plate 202 is accomplished by removing bolts 214–216, and then rotating divider plate 202 by 90° about axis 62, as shown at arrows 255, 256 in FIG. 12, to a horizontal position as shown in dashed line at 257. The now horizontal divider plate 202 at position 257 is then withdrawn axially through door opening 258 in the mill head axial end, with door 250 is in its open position, FIGS. 12 and 13. In applications where the divider plate has inner end flanges 259 and 260 extending radially beyond the noted inner perimeter, then such flanges are removed prior to withdrawal of the divider plate.

Door 250 is pivoted about a horizontal hinge line 261 spaced below axis 62 at hinges 262 and 264. The horizontal length of the bottom 266 of the door along hinge line 260 is less than inner diameter 162. The top 268 of the door is spaced above axis 62 and extends horizontally and has a horizontal length greater than inner diameter 162. Top 268 lies in a horizontal plane vertically spaced above bottom 266 by a distance less than inner diameter 162. The door has distally opposite right and left sides 270 and 272. The mill head defines a cylinder whose axial projection as shown at 274 in FIG. 11 through the axial end of the mill head intersects distally opposite top and bottom sides 268 and 266 but not the pair of distally opposite right and left sides 270 and 272. Sides 270 and 272 are spaced laterally outwardly of axial projection 274 of the cylinder. Sides 270 and 272 are spaced apart by a distance greater than inner diameter 162.

Door 250 in its closed position spans divider wall 202 at leading axial diagonal end 212 of triangular portion 206 and closes both entrance 80 and exit 86 of the mill head. Door 250 in its open position, FIG. 12, exposes both entrance 80 and exit 86. Axial end 212 of the divider plate is engaged by door 250 in its closed position and is bolted thereto by bolts 218. As above noted, divider plate 202 at its outward axial end includes triangular portion 206 having a substantially vertical leg 208 extending along inner diameter 162, a substantially horizontal leg 210 extending axially outwardly from vertical leg 208, and a diagonal leg 212 joining the vertical and horizontal legs. Door 250 engages the axially outwardly facing end of diagonal leg 212. Horizontal leg 210 extends axially from the top of vertical leg 208, and diagonal leg 212 extends from the bottom of vertical leg 208 axially outwardly and upwardly.

Door 250 has a polygonal perimeter engaging the axial end of the mill head along a beveled interface 274, 276, FIG. 13, to guide a nested and sealed engagement of the door therewith. The lower beveled edge of the door has the noted hinges 262,264 mounted thereto. In the preferred embodiment, the polygonal perimeter of the door has six sides, all beveled, including the noted top and bottom parallel sides 268 and 266 spaced by a distance less than inner perimeter 162, the noted right and left parallel sides 270 and 272 spaced by a distance greater than inner diameter 162, and fifth and sixth non-parallel sides 278 and 280, FIG. 11. Side 278 extends between sides 266 and 270. Side 280 extends between sides 266 and 272. Door 250 and door opening 258 preferably have strips bolted or tack welded thereto to provide good sealing engagement. The door is held in its closed position by bolts 218, 282, 284 and a plurality of perimeter bolts 286.

In an alternative embodiment, a small opening may be provided through door 250, and a small sub-door is added thereto, similarly to door 32, to provide limited access even with door 250 in its closed position. Door 250 would still have to be opened to enable removal of divider plate 202, at least without cutting the latter into smaller sub-pieces as noted above.

Figure 15:
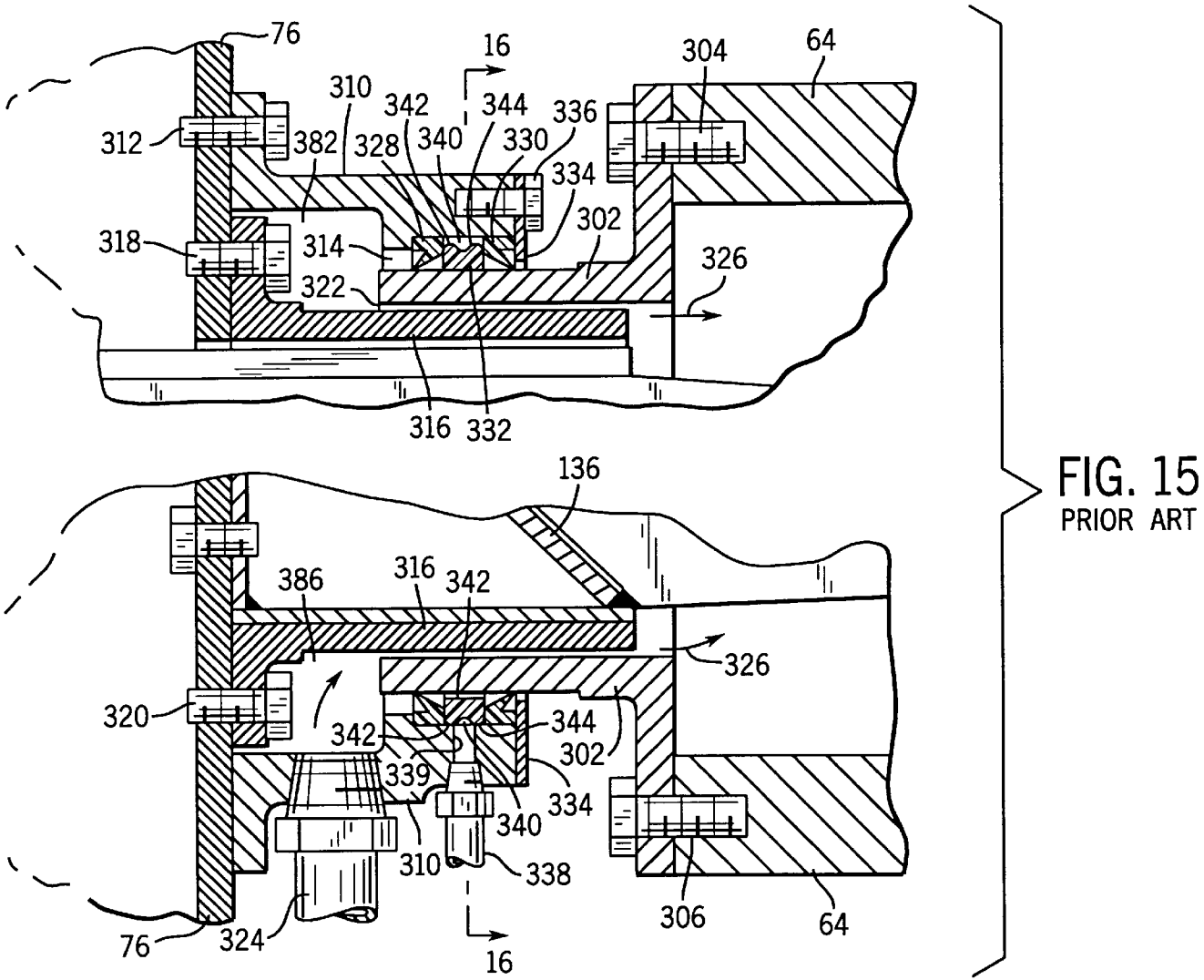
FIG. 15 PRIOR ART
FIG. 15 is an enlarged sectional view, showing the mill head trunnion sealing arrangement of the prior art.

FIG. 15. shows the prior art mill head trunnion sealing arrangement. Mill head 64 has a cylindrical mill head extension 302 bolted thereto by bolts such as 304,306 and extending axially therefrom. An outer annular stationary seal ring 310 is bolted to stationary framework 76 at bolts such as 312 and extends axially therefrom and is concentric with and surrounds mill head extension 302 and defines an annular gap 314 therebetween. An inner annular stationary seal sleeve 316 is bolted to stationary framework 76 by bolts such as 318, 320 and extends axially therefrom and is concentric with and surrounded by mill head extension 302 and defines an annular gap 322 therebetween. Seal ring 310 has a seal air fitting 324 for introducing air to the mill head to create a pressure differential at the area of the seal, to prevent coal dust from entering the area. The airflow path is shown at arrows 326 through gap 322. A pair of axially spaced annular seals 328 and 330 are provided between mill head extension 302 and ring 310 and seal annular gap 314 therebetween to prevent leakage of coal dust through such gap. A spacer 332 is provided between the seals. The seals and spacer are held in place by annular retainer plate 334 and bolts such as 336 secured to seal ring 310. Seal ring 310 has grease fittings such as 338 for supplying grease through passages such as 339 to outer groove 340 of spacer 332 to lubricate same as mill head extension 302 rotates within stationary ring 310. The disclosed structure is known in the art and is called a seal cage.

Figure 16:
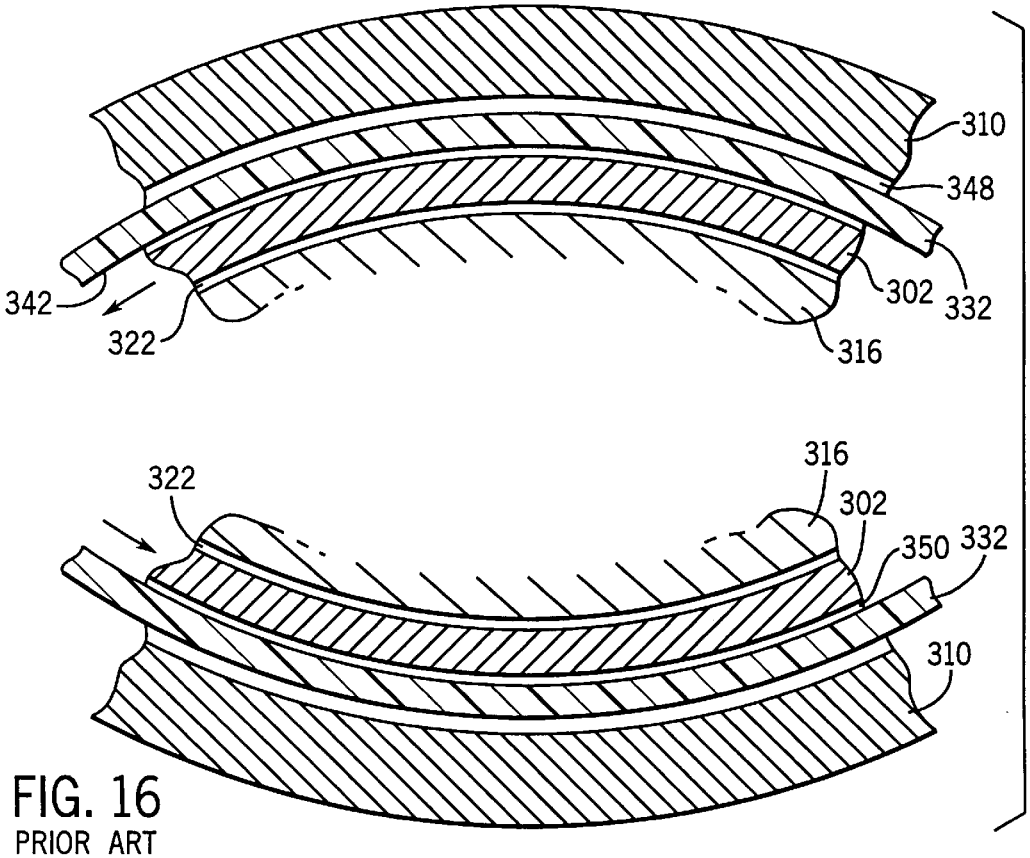
FIG. 16 PRIOR ART
FIG. 16 is a sectional view taken along line 16—16 of FIG. 15.

Spacer 332 has an inner circumference defined by a flat surface 342, and an outer circumference defined by a pair of humps 344 and 346 on opposite sides of groove or channel 340. The spacer is typically a metal member and rests as shown in FIG. 16 with its flat inner circumference surface 342 against the top of mill head extension 302, and with its lower humped outer circumference resting against the upwardly facing lower portion of ring 310. The weight of metal spacer member 332 contributes to the noted resting and wear surfaces. It is believed that the prior problems with coal dust leakage are due to rolling movement of seal 328 and/or seal 330 around spacer 332 into the radial gap 348, FIG. 16, between the top of spacer 332 and the underside of ring 310, and/or rolling movement of seal 328 and/or seal 330 around spacer 332 into the radial gap 350, FIG. 16, between the inner circumference of spacer 332 and the mill head extension 302 thereabove. The rolling movement of seal 328 and/or seal 330 is transverse to the direction of rotation of the mill head and parallel to the axis 62 of such rotation.

Figure 17:
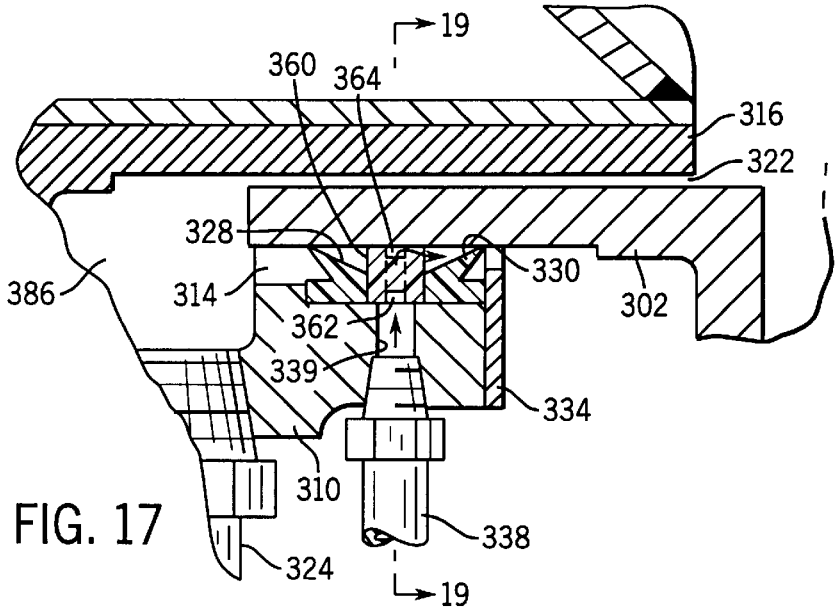
FIG. 17 is a view like a portion of FIG. 15, but illustrates the sealing arrangement in accordance with the present invention.
Figure 18:
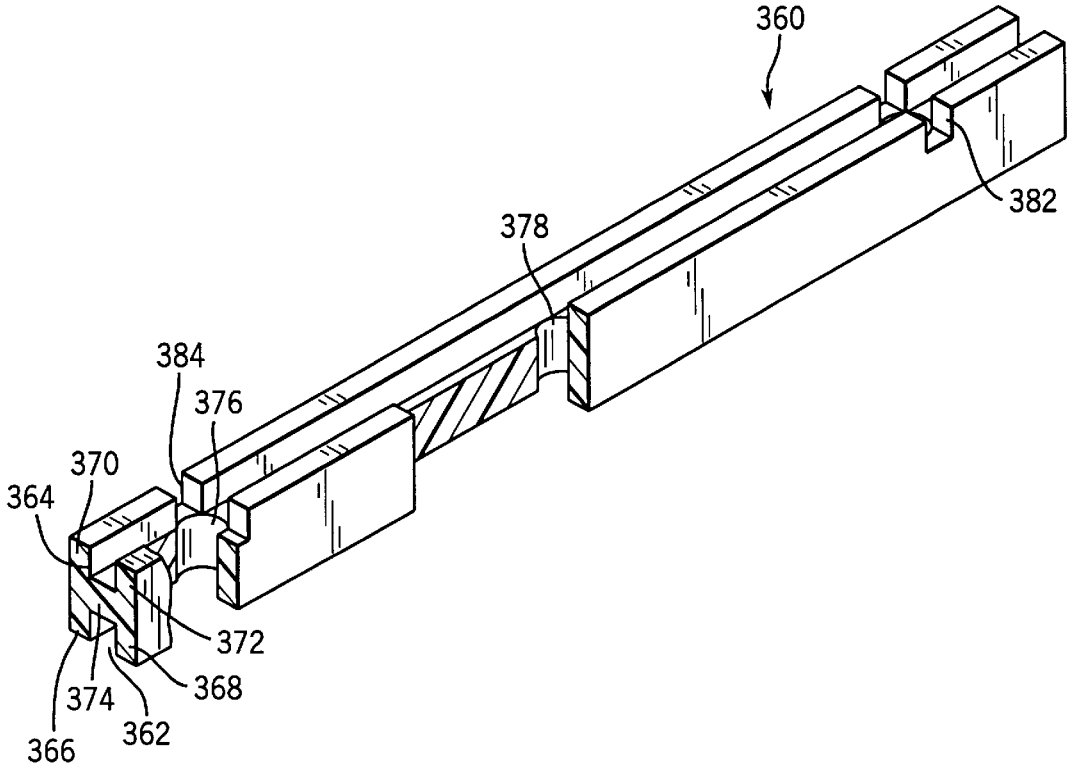
FIG. 18 is a sectional view taken along line 18—18 of FIG. 17.
Figure 19:
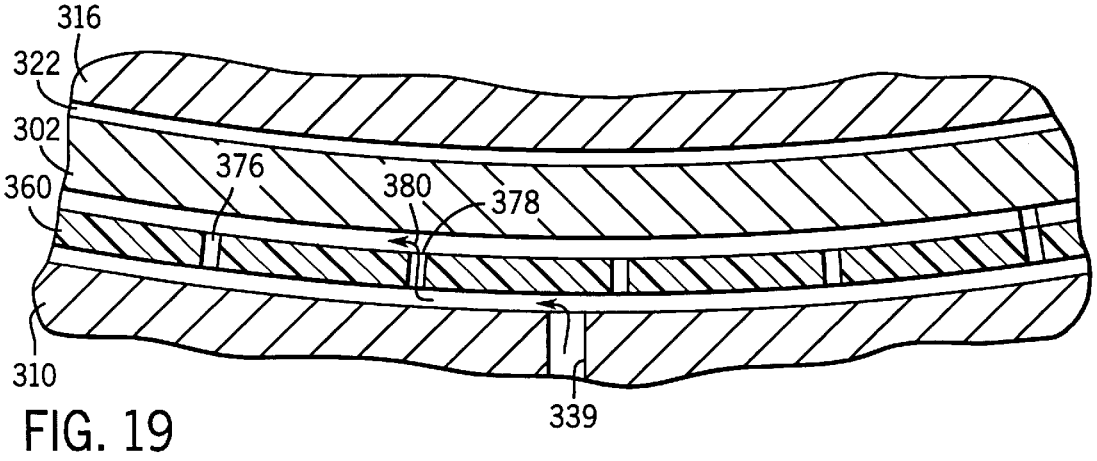
FIG. 19 is a perspective view partially in section of the spacer of FIGS. 17 and 18

FIGS. 17–19 show mill modifications in accordance with the present invention, specifically a sealing spacer arrangement, and use like reference numerals where appropriate to facilitate understanding. Spacer 332 of FIGS. 15 and 16 is replaced with an annular plastic member 360 substantially filling the entire gap 314 between mill head extension 302 and ring 310 around the entire annulus thereof and preventing rolling movement of seals 328 and 330 into the annular interfaces or gaps such as 348 and 350, FIG. 16, between spacer 360 and mill head extension 302 and between spacer 360 and ring 310 as mill head extension 302 rotates relative to ring 310. Spacer 360 is preferably plastic, preferably polyethylene.

Spacer 360 is an annular member having an outer circumferential groove 362 and an inner circumferential groove 364 defining an H-shape in cross-section having a pair of radially outwardly extending outer legs 366 and 368, FIG. 18, with outer groove 362 therebetween, and a pair of radially inwardly extending inner legs 370 and 372 with inner groove 364 therebetween, and a central bight 374 radially between outer and inner grooves 362 and 364. A plurality of passages 376, 378, etc., are provided through bight 374 and provide communication between outer and inner grooves 362 and 364. Grease fitting 338 in ring 310 supplies grease through passage 339, FIGS. 17 and 19, to outer groove 362, which grease is in turn fed through passages 376, 378, etc., as shown at arrow 380, to inner groove 364. Radially inwardly extending inner legs 370 and 372 of spacer 360 have a plurality of slots, 382, 384, etc. formed therethrough for supplying grease from inner groove 364 axially in opposite directions through legs 370 and 372 towards respective seals 328 and 330.

Ring 310 surrounds mill head extension 302. Outer groove 362 of spacer 360 faces ring 310. Inner groove 364 of spacer 360 faces mill head extension 302. Stationary seal sleeve 316 is concentric with seal ring 310 and mill head extension 302 and is spaced inwardly of mill head extension 302 by annular air gap 322. Ring 310 is spaced radially outwardly of sleeve 316 and defines a seal air chamber 386 therebetween. Air fitting 324 on ring 310 supplies air to seal air chamber 386. Seal 328 is axially between seal air chamber 382 and spacer 360.

It is recognized that various equivalents, alternatives and modifications are possible within the scope of the appended claims.

What is claimed is:

1. In a mill in a coal-burning utility electrical power generation plant, said mill comprising a rotary drum for pulverizing coal, said drum being rotational about an axis and having a mill head at an axial end thereof, said mill head having a cylindrical mill head extension extending axially, a stationary cylindrical seal ring concentric with said mill head extension and defining an annular gap therebetween, a pair of axially spaced annular seals between said mill head extension and said seal ring and sealing said annular gap therebetween to prevent leakage of coal dust through said annular gap, a spacer between said seals and maintaining said seals in axially spaced relation, said spacer comprising an annular member substantially filling the entire gap between said mill head extension and said seal ring around the entire annulus thereof and preventing rolling movement of said seals into the annular interfaces between said spacer and said mill head extension and between said spacer and said seal ring as said mill head extension rotates relative to said seal ring.

2. The invention according to claim 1 wherein said spacer is plastic.

3. The invention according to claim 2 wherein said spacer is polyethylene.

4. In a mill in a coal-burning utility electrical power generation plant, said mill comprising a rotary drum for pulverizing coal, said drum being rotational about an axis and having a mill head at an axial end thereof, said mill head having a cylindrical mill head extension extending axially, a stationary cylindrical seal ring concentric with said mill head extension and defining an annular gap therebetween, a pair of axially spaced annular seals between said mill head extension and said seal ring and sealing said annular gap therebetween to prevent leakage of coal dust through said annular gap, a spacer between said seals and maintaining said seals in axially spaced relation, said spacer comprising an annular member having an outer circumferential groove and an inner circumferential groove defining an H-shape in cross-section having a pair of radially outwardly extending outer legs with said outer groove therebetween, and a pair of radially inwardly extending inner legs with said inner groove therebetween, and a central bight radially between said outer and inner grooves, a plurality of passages through said bight and providing communication between said outer and inner grooves, said seal ring having a grease fitting for supplying grease to one of said grooves, which grease is in turn fed through said passages to the other of said grooves.

5. The invention according to claim 4 wherein said seal ring surrounds said mill head extension, said outer groove faces said seal ring, and said inner groove faces said mill head extension.

6. The invention according to claim 5 comprising a stationary cylindrical sleeve concentric with said seal ring and said mill head extension and spaced inwardly of said mill head extension by an annular air gap.

7. The invention according to claim 6 wherein said seal ring is spaced radially outwardly of said sleeve and defines a seal air chamber therebetween, and comprising an air fitting on said seal ring supplying air to said seal air chamber, and wherein said grease fitting on said seal ring supplies grease to said outer groove, and wherein one of said seals is axially between said seal air chamber and said spacer.

8. The invention according to claim 5 wherein said radially inwardly extending inner legs of said H-shape of said spacer have a plurality of slots formed therethrough for supplying grease from said inner groove axially in opposite directions through said inner legs towards said seals.

9. A mill for a coal-burning utility electrical power generation plant comprising a rotary drum for pulverizing coal, said drum being rotational about an axis and having a mill head at an axial end thereof, said mill head having a cylindrical mill head extension extending axially, a stationary cylindrical seal ring concentric with said mill head extension and a defining an annular gap therebetween, a pair of axially spaced annular seals between said mill head extension and said seal ring and sealing said annular gap therebetween to prevent leakage of coal dust through said annular gap, a spacer between said seals and maintaining said seals in axially spaced relation, said spacer comprising an annular plastic member substantially filling the entire gap between said mill head extension and said seal ring around the entire annulus thereof and preventing rolling movement of said seals into the annular interfaces between said spacer and said mill head extension and between said spacer and said seal ring as said mill head extension rotates relative to said seal ring, said spacer having an outer circumferential groove and an inner circumferential groove defining an H-shape in cross-section having a pair of radially outwardly extending outer legs with said outer groove therebetween, and a pair of radially inwardly extending inner legs with said inner groove therebetween, and a central bight radially between said outer and inner grooves, a plurality of passages through said bight and providing communication between said outer and inner grooves, said seal ring surrounding said mill head extension, said outer groove facing said seal ring, said inner groove facing said mill head extension, said seal ring having a grease fitting for supplying grease to said outer groove, which grease in turn is fed through said passages to said inner groove.

10. The invention according to claim 9 wherein said radially inwardly extending inner legs of said H-shape of said spacer have a plurality of slots formed therethrough for supplying grease from said inner groove axially in opposite directions through said inner legs towards said seals.

* * * * *